US005700970A

United States Patent [19]

McNicol

[11] Patent Number: 5,700,970

[45] Date of Patent: Dec. 23, 1997

[54] BROKEN-EMULSION AND PROCESS FOR RECYCLING EMULSION EXPLOSIVES

[75] Inventor: Melvin Adam McNicol, Quebec, Canada

[73] Assignee: ICI Canada Inc., Canada

[21] Appl. No.: 543,086

[22] Filed: Oct. 13, 1995

[51] Int. Cl.[6] ..... F42B 3/00; C06B 45/10

[52] U.S. Cl. ..... 102/332; 149/19.91; 149/19.6

[58] Field of Search ..... 102/332; 149/19.91, 149/19.6

[56] References Cited

U.S. PATENT DOCUMENTS

| | | | |
|---|---|---|---|
| 3,770,524 | 11/1973 | Walker et al. | 149/19.5 |
| 3,972,820 | 8/1976 | Filter et al. | 149/19.1 |
| 4,038,115 | 7/1977 | Dehm | 149/19.8 |
| 4,525,225 | 6/1985 | Cechanski | 149/19.5 |
| 5,071,496 | 12/1991 | Coursen et al. | 149/21 |
| 5,076,868 | 12/1991 | Doll et al. | 149/19.4 |
| 5,283,001 | 2/1994 | Gregoli et al. | 44/301 X |

*Primary Examiner*—Peter A. Nelson

[57] ABSTRACT

The present invention is directed to the manufacture of a broken-emulsion which is comprised of polyglycol bottoms and emulsion. The broken-emulsion can be made from waste emulsion and can subsequently be used as a fuel component and/or oxidizer in an explosive.

23 Claims, No Drawings

BROKEN-EMULSION AND PROCESS FOR RECYCLING EMULSION EXPLOSIVES

BACKGROUND OF THE INVENTION

The present invention is directed to a combination of emulsion and polyglycol bottoms making a broken-emulsion defined hereinbelow, and to a method of recycling emulsion explosives and waste products from emulsion explosives for use as an explosive.

Emulsion explosives are widely used in the explosives industry, and have found acceptance for a number of applications. These explosives generally comprise a discontinuous phase of an aqueous solution, or melt, of an oxidizer salt, which discontinuous phase has been emulsified into a water-immiscible organic fuel phase. In practice, a key element in producing a useful, stable emulsion explosive is the selection of a suitable emulsifier to provide the desired emulsion explosive properties.

Although emulsion explosives are now commonly and widely produced in the explosive industry, on occasion, product is prepared which for one reason or another is deemed unsuitable for a particular application. These waste materials must be re-processed and/or destroyed in order to avoid the accumulation of waste emulsion explosive. One common method of destroying waste emulsion explosives is by incineration. However, this procedure results in the loss of all materials and, when it is necessary to destroy large quantities of waste emulsion explosive, as might occur in some bulk explosive applications, the cost of incineration combined with the cost of replacement of the waste material, can be a significant expense.

Additionally, with increased awareness of environmental issues, the incineration of these materials is becoming less acceptable, and has become more closely controlled by various regulatory authorities.

Another method for the re-processing of waste emulsion explosive is by the addition of soaps and/or surfactants which break-down the emulsion into an aqueous oxidizer salt phase and an oil phase. The two phases can be separated, to a certain extent, and each phase re-used. However, separation of the two phases is a time consuming process, and complete separation of the two phases is not readily achievable. Thus, the two phases generated are not typically of acceptable quality to allow their re-use in the production of additional explosive. Generally, the two phases are "discarded" by use in a non-explosives related application. Thus, the value of these materials as emulsion explosive ingredients is lost.

It would be a clear benefit to the emulsion explosive art to provide a simple, rapid procedure for the re-processing of waste emulsion explosive which procedure avoids the problems of previous re-processing methods. An additional desirable benefit would result if the various components of the reprocessed material could be utilized in an explosives-related application.

SUMMARY OF THE INVENTION

The present invention is directed to an admixture comprised of polyglycol bottoms and emulsion to form a substantially single liquid phase broken-emulsion and/or fuel ("broken-emulsion") that is no longer a true emulsion. This broken-emulsion is characterized by a substantially single liquid phase solution derived from emulsion and polyglycol bottoms wherein the emulsion is broken down into its separate phases and essentially dissolved as one liquid phase in solution containing polyglycol bottoms whereby said solution is a broken-emulsion. Subsequently, solid ammonium nitrate is added to this broken-emulsion to make an explosive.

Essentially dissolved does not necessarily mean that all combined emulsions are dissolved but that all emulsions possible to dissolve with the concentration of solvent present for dissolution are indeed dissolved. Should not all of the emulsion be dissolved due to the lack of a corresponding solvating liquid, emulsion may be available as a discontinuous phase, outside of the broken-emulsion phase which is substantially a single phase. For example, it is possible that only enough of the polyglycol bottoms is present to dissolve half of the emulsion present. Accordingly, half of the emulsion will be converted to broken-emulsion, the other half may remain as an emulsion. Thusly, the admixture will comprise a substantially single liquid phase of broken-emulsion with islands of emulsions contained therewithin. This admixture of broken-emulsion and emulsion will be sufficient to provide a fuel for a solid oxidizer to make an explosive.

By the addition of polyglycol bottoms to emulsions in a ratio of 0.5 to 1 by volume, respectively, it is found that the emulsion breaks down into a single liquid phase solution. Additional solid phases may be present, but the liquid phase is substantially one phase. The intermixed volume ratio of polyglycol bottoms and emulsion is somewhat forgiving and may range from 0.5:1 to 40:1, more preferably 1:1 to 3:1, with the most preferable embodiment 1.5:1 to 2.5:1. This single liquid phase solution may then be used as a broken-emulsion which when mixed with ammonium nitrate may be used as an explosive. This mix may then be used as part of a blast shot with little or no decrease in shot efficiency.

Polyglycol bottoms may be a mixture of different organic liquids. Sensibly one, some or many of the organics present interact with the emulsion to cause this liquid phase break down. Accordingly, the inventors hereof attempted a similar solvation of the emulsion using single or mixed solvent systems that are a part of the polyglycol bottoms make-up. For example, polyethylene glycol of 400 and 1000 molecular weights were used as solvents with no effect on the emulsion. Methanol was able to break the emulsion down but separate phases were created from the emulsion. Diethylene glycol had no effect, neither did a mixture of polyethylene glycol and an alcohol, such as ethanol. Surprisingly, there is some special characteristic or serendipity about the polyglycol bottoms that creates this apparently single liquid phase broken-emulsion derived from emulsions.

Accordingly, the present invention provides a product and a process for the reprocessing of emulsion explosive, the product of which may incorporate polyglycol bottoms in emulsions for use as a broken-emulsion wherein said emulsion explosive comprises a mixture of a fuel, oxidizer salt and optionally water. The process underpinning this broken-emulsion comprises the steps of treating an emulsion explosive with a sufficient amount of an oxidizer, fuel and optionally water-solvating liquid, to produce an essentially homogenous mixture of oil, dissolved oxidizer salt, optionally water, and solvating liquid.

The oxidizer, fuel and water-solvating liquid (hereinafter "solvating liquid") may be any material in which the ingredients of the emulsion explosive are soluble, or will form an essentially homogeneous single liquid phase. Preferred solvating materials include glycols and/or polyglycols, or mixtures thereof and therebetween, with the most preferred polyglycol bottoms.

The phrase "essentially or substantially single liquid phase" as used herein, is to be interpreted to mean that the admixture provides a liquid-like material which is free flowing and which does not separate into distinct liquid phase layers, or that any separation of the materials can be readily reversed by simple mixing. However, the single liquid phase definition is directed to the broken-emulsion and does not exclude either unbroken emulsion or solid oxidizers from being independently dispersed within and/or throughout the broken-emulsion as islands of their respective species. This is in distinct contrast to the prior art.

Depending on the ratios and amounts of emulsion and solvating liquid, such as, for example, glycol and/or polyglycols, however, there may be excess oxidizer salt to be suspended or dissolved into the water/oil/glycol-polyglycol mixture. This excess oxidizer salt may form solid crystals in the mixture which can be separated from the mixture, or which may preferably be dissolved into the mixture by the addition of water or additional solvating liquids, such as glycol and/or polyglycols.

In practice, as solvating liquid, and preferably a glycol, a polyglycol or a mixture thereof and therebetween (hereinafter glycol/polyglycol), is added to the waste emulsion, the emulsion rapidly breaks-down to form the substantially single liquid phase or broken-emulsion. The amount of solvating liquid required may be dependent on the composition of the waste emulsion. Typically, however, only enough of the solvating liquid is added to liquify the waste emulsion material. As stated above, generally, the solvating liquid, such as glycol/polyglycol, is added in an amount of at least a ratio of between 0.5:1 solvating liquid to emulsion (by weight). More preferably, the ratio of solvating liquid to waste emulsion is between 0.5:1 to 20:1, and more preferably still between 1:1 to 3:1. Most preferably, this ratio is between 1.5:1 and 2.5:1.

The rather simple process of the present invention is able to produce a substantially single liquid phase broken-emulsion which preferably provides a non-separation stability time of greater than 1 week, and more preferably, of greater than 30 days.

The process of the present invention may be conducted at any typically encountered ambient temperature, but preferably is conducted at a temperature of about 15° to 25° C. However, in general, the process can be conducted at any temperature wherein the materials involved can be safely handled, and wherein the solvating liquid will be a free-flowing liquid. Under some circumstances, such as, for example, where low levels of solvating liquid are added, the oxidizer salt dissolved or suspended in the broken-emulsion may cause part or all of the mixture to partially 'solidify' into a high viscosity material. This phenomena, termed as "fudging" in the explosives art, may be countered by heating to effect liquification of the mixture.

The glycol/polyglycol materials utilized are preferably commonly occurring materials which can be readily, and inexpensively obtained. These include materials having the formula:

$$HO—[CR_1R_2—CR_3R_4—O]_n—H$$

wherein $R_1$ to $R_4$ are each independently hydrogen or $C_1$ to $C_{10}$ alkyl, and more preferably hydrogen or $C_1$ to $C_6$ alkyl, and 'n' is from 1 to 30 and more preferably from 1 to 6; or mixtures thereof and therebetween. Most preferably, no more than one of $R_1$ to $R_4$ is other than hydrogen.

Accordingly, the glycol/polyglycol material is preferably a mono, bi, tri, tetra ethylene glycol and their methyl, ethyl, propyl etc. ethers.

Also, preferably, the glycol/polyglycol material utilized is a polyglycol which contains ether and hydroxyl functionality, or is a mixture of both glycol and polyglycols containing a variety of ether and hydroxyl groups. A most preferred material for this application is generically known as "polyglycol bottoms". One preferred material of the polyglycol bottom type is commercially available from, for example, KMCO Inc. of the United States, under the trade name of PGB-90. This material is described by the supplier as a mixture of glycol and polyglycols which are available as a black liquid having a boiling point of (about) 475° F. (245° C.), a pH of 6.5–9.0, a density of 1.125– 1.200 and a freezing point of less than –50° F. (–45° C.). These polyglycol bottoms are generally supplied containing some water which is generally not detrimental to the process of the present invention.

A typical sample of a commercially available polyglycol bottoms may have the formulation as set out in Table 1. However, this composition may vary from sample to sample.

TABLE 1

Typical Polyglycol Bottoms Organic Component Composition*

| COMPONENT | % by weight |
|---|---|
| Diethylene glycol | 3.71 |
| Diethylene glycol butyl ether | 2.41 |
| Triethylene glycol | 22.68 |
| Triethylene glycol ethyl ether | 3.43 |
| Tetraethylene glycol | 26.66 |
| Tetraethylene glycol ethyl ether | 2.08 |
| Tetraethylene glycol butyl ether | 1.62 |
| Pentaethylene glycol | 13.03 |
| Pentaethylene glycol ethyl ether | 2.85 |
| Pentaethylene glycol hexyl ether | 1.08 |
| Pentaethylene glycol butyl ether | 6.24 |
| Hexaethylene glycol | 2.50 |
| Hexaethylene glycol butyl ether | 6.56 |
| Heptaethylene glycol butyl ether | 4.34 |
| Octaethylene glycol butyl ether | 0.80 |

*Polyglycol bottoms, as receive, typically comprise a mixture of about 80% organic material and about 20% by weight of water. The amount of water can vary as well as the pH.

Waste emulsion explosive may be any of the known and/or commercially available emulsion explosive, or products similar to these explosives. These emulsion explosives are described in detail hereinbelow. Further, the waste emulsion explosive to be treated by the procedure of the present invention may form part of an emulsion explosive-containing explosive composition, such as, for example, doped emulsion, Heavy ANFO and the like, which are known in the industry. Further, the term emulsion may be considered to include both water-in-oil emulsions (typically termed "Emulsion explosives" in the industry as slurry or water-gel explosives). Preferably, however, the treated "emulsion" is a water-in-oil emulsion explosive.

The substantially single liquid phase broken-emulsion produced by the above described process may be easily sprayed onto, or mixed with, a variety of materials for further use. Preferably, the broken-emulsion is used, in general, as the fuel phase (or as part of the fuel phase) of an explosive composition. Accordingly, in a further aspect, the present invention provides a broken-emulsion and a means for reprocessing waste emulsion explosive wherein the inventive broken-emulsion is mixed with a solid oxidizer salt in order to produce an explosive. In this application, the broken-emulsion supplies the fuel phase in the production of ANFO (ammonium nitrate—fuel oil) type explosive wherein a solid oxidizer salt is coated with a fuel oil. The broken-emulsion thus provides not only the fuel phase in this mixture, but also a small amount of oxidizer salt.

It should be noted that, typically, the broken-emulsion is not an explosive, or in particular, a sensitized explosive, and thus may be safely and readily handled.

The amount of broken-emulsion which may be mixed into the oxidizer salt is dependent on the oxidizer salt chosen and the desired properties of the explosive to be produced. If possible, it is preferable that the broken-emulsion/fuel/oxidizer salt explosive be oxygen balanced in order to minimize or avoid the generation of noxious, gaseous by-products.

Any one of a variety of solid oxidizer salts may be utilized in this application. This would include oxidizer salts that have crystallized in an emulsion. Heretofore, when an oxidizer salt crystallizes in an emulsion, the emulsion must be disposed of. When used in combination with the broken-emulsion, the crystallized emulsion becomes a viable source of oxidizer as well as fuel. Preferred oxidizer salts in this application are also those oxidizer salts which are preferred in the production of emulsion explosives which are described hereinbelow. However, a preferred oxidizer salt is ammonium nitrate, and more preferably is ammonium nitrate in prill form. It is also preferable that the ammonium nitrate prill form be combined with fuel oil. It is further preferable that the ammonium nitrate prill be an explosive grade ammonium nitrate (EGAN), which thus, provides sufficient oil absorption to provide an ANFO-type explosive. The fertilizer grade ammonium nitrate either in crystal or prill form (FGAN) may also be used as the ammonium nitrate source.

Depending on the composition of the broken-emulsion, and the type of oxidizer salt chosen, the amount of broken-emulsion utilized can vary. However, preferably, the level of broken-emulsion present in the oxidizer/broken-emulsion mixture is less than 50%, and more preferably is between 5 and 40% by weight. Most preferably, the amount of agent is between 10 and 35%. Another component usable within this mixture is washdown-water. Washdown-water is simply water used to wash away spilt or waste emulsion. This water can be and often is collected. This collected washdown-water may in turn be added to the broken-emulsion and made a component of the explosive mix. Advantageously, washdown-water may be used up to about 15% by weight with the broken-emulsion oxidizer explosive.

In a further aspect, the present invention provides an explosive composition which has been prepared by mixing a solid oxidizer salt with the broken-emulsion, prepared in accordance with the inventive process described hereinabove. This product is preferably produced on site and may be loaded directly into the borehole. However, the product may also be prepared off-site, and may be shipped in bulk, or as a packaged product, so long as the stability of the individual composition is satisfactory for the intended use.

The product prepared may then be used as part of various known explosive compositions utilizing ANFO-type explosives. These include, for example, Heavy ANFO, doped emulsions, and the like, which are known within the industry.

In the practice of the present invention, the emulsion explosive is likely to be a waste material which, for one reason or another, is found unsuitable for use in its waste state. Thus, the emulsion explosive composition may not provide the optimum emulsion explosive composition, but will preferably, be similar to the optimum formulations described hereinbelow. However, minor variations from standard emulsion explosive formulations may be tolerated. Thus, the emulsion explosives to be reprocessed according to the present invention may be any of the emulsion explosives known in the industry, packaged, bulk, or otherwise.

While emulsion explosives are widely known and described in the industry literature, the features of typical emulsion explosives may be described as follows.

The oxidizer salt for use in the discontinuous phase of the emulsion is preferably selected from the group consisting of alkali and alkaline earth metal nitrates, chlorates and perchlorates, ammonium nitrate, ammonium chlorates, ammonium perchlorate and mixtures thereof. It is particularly preferred that the oxidizer salt is ammonium nitrate, or a mixture of ammonium and sodium nitrate. For example, one preferred oxidizer salt mixture comprises a solution of 77% ammonium nitrate, 11% sodium nitrate and 12% water.

The oxidizer salt is typically a concentrated aqueous solution of the salt or mixture of salts. However, the oxidizer salt may also be a liquified, melted solution of the oxidizer salt where a lower water content is desired. Further, one preferred type of emulsion explosive provides that the discontinuous phase of the emulsion explosive be a eutectic composition. Eutectic composition means that the melting point of the composition is either at the eutectic or in the region of the eutectic or the components of the composition.

The oxidizer salt for use in the discontinuous phase of the emulsion may further comprise a melting point depressant. These melting point depressants are generally added to the aqueous phase of the emulsion and in small amounts so as to avoid interfering with the stability of the emulsion explosive formed. Suitable melting point depressants for use with ammonium nitrate in the discontinuous phase include inorganic salts such as lithium nitrate, silver nitrate, lead nitrate, sodium nitrate, potassium nitrate; alcohols such as methyl alcohol, ethylene glycol, glycerol, mannitol, sorbitol, pentaerythritol; carbohydrates such as sugars, starches and dextrins; aliphatic carboxylic acids and their salts such as formic acid, acetic acid, ammonium formate, sodium formate, sodium acetate, and ammonium acetate; glycine; chloracetic acid; glycolic acid; succinic acid; tartaric acid; adipic acid; lower aliphatic amides such as formamide, acetamide and urea; urea nitrate; nitrogenous substances such as nitrguanidine, guanidine nitrate, methylamine, methylamine nitrate, and ethylene diamine dinitrate; and mixtures thereof.

Typically, the discontinuous phase of the emulsion comprises 60 to 97% by weight of the emulsion explosive, and preferably 86 to 95% by weight of the emulsion explosive.

The continuous water-immiscible organic fuel phase of the emulsion explosive comprises an organic fuel. Suitable organic fuels, for use in the continuous phase include aliphatic, alicyclic and aromatic compounds and mixtures thereof which are in the liquid state at the formulation temperature. Suitable organic fuels may be chosen from fuel oil, diesel oil, distillate, furnace oil, kerosene, naphtha, waxes, (e.g. microcrystalline wax, paraffin wax and slack wax), paraffin oils, benzene, toluene, xylenes, asphaltic materials, polymeric oils such as the low molecular weight polymers of olefins, animal oils, fish oils, vegetable oils, and other mineral, hydrocarbon or fatty oils, and mixtures thereof. Preferred organic fuels include liquid hydrocarbons, generally referred to as petroleum distillate, such as gasoline, kerosene, fuel oils and paraffin oils. However, a preferred organic fuel phase comprises vegetable oil.

Typically, the continuous water-immiscible organic fuel phase of the emulsion explosive comprises 3 to 30% by weight of the emulsion explosive, and preferably 5 to 15% by weight of the emulsion explosive.

The emulsion explosive also typically comprises an emulsifier component to aid in the formation to the emulsion, and to improve the stability of the emulsion. The emulsifier component may be chosen from the wide range of emulsifying agents known in the art to be suitable for the preparation of emulsion explosive compositions. Examples of such emulsifying agents include alcohol alkoxylates, phenol alkoxylates, poly (oxyalkylene) glycols, poly (oxyalkylene) fatty acid esters, amine alkoxylates, fatty acid esters of sorbitol and glycerol, fatty acid salts, sorbitan esters, poly (oxyalkylene) sorbitan esters, fatty amine alkoxylates, poly (oxyalkylene)glycol esters, fatty acid amides, fatty acid amide alkoxylates, fatty amine, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly (oxyalkylene) glycols and poly (12-hydroxystearic acid), condensation products of compounds comprising at least one primary amine and poly[alk(en)yl]succinic acid or anhydride, and mixtures thereof.

Among the preferred emulsifying agents are the 2-alkyl- and 2-alkenyl-4, 4'-bis(hydroxymethyl)oxazolines, the fatty acid esters of sorbitol, lecithin, copolymers of poly (oxyalkylene)glycols and poly(12-hydroxystearic acid), condensation products of compounds comprising at least one primary amine and poly[alk(en)yl]succinic acid or anhydride, and mixtures thereof.

More preferably the emulsifier component comprises a condensation product of a compound comprising at least one primary amine and a poly[alk(en)yl]succinic acid or anhydride. A preferred emulsifier is a polyisobutylene succinic anhydride (PIBSA) based surfactant, which surfactants are known within the emulsion explosives art. A preferred emulsion explosive composition is one in which the emulsifier is a condensation product of a poly[alk(en)yl]succinic anhydride and an amine such as ethylene diamine, diethylene triamine and ethanolamine.

Typically, the emulsifier component of the emulsion explosive comprises up to 5% by weight of the emulsion explosive composition. Higher proportions of the emulsifier component may be used and may serve as a supplemental fuel for the composition, but in general it is not necessary to add more than 5% by weight of emulsifier component to achieve the desired effect. Stable emulsions can be formed using relatively low levels of emulsifier component and for reasons of economy, it is preferable to keep to the minimum amounts of emulsifier necessary to achieve the desired effect. The preferred level of emulsifier component used is in the range of from 0.4 to 3.0% by weight of the emulsion explosive.

If desired other, optional fuel materials, hereinafter referred to as secondary fuels, may be incorporated into the emulsion explosives. Examples of such secondary fuels include finely divided solids. Examples of solid secondary fuels include finely divided materials such as: sulfur; aluminum; carbonaceous materials such as gilsonite, comminuted coke or charcoal, carbon black, resin acids such as abietic acid, sugars such as glucose or dextrose, and other vegetable products such as starch, nut meal, grain meal and wood pulp; and mixtures thereof.

Typically, the optional secondary fuel component of the emulsion explosive comprises from 0 to 30% by weight of the emulsion explosive.

The explosive composition is preferably oxygen balanced. This may be achieved by providing a blend of components which are themselves oxygen balanced or by providing a blend which, while having a net oxygen balance, comprises components which are not themselves oxygen balanced. This provides a more efficient explosive composition which, when detonated, leaves fewer unreacted components. Additional components may be added to the explosive composition to control the oxygen balance of the explosive composition.

The emulsion explosive may additionally comprise a discontinuous gaseous component which gaseous component can be utilized to vary the density and/or the sensitivity of the emulsion explosive. The methods of incorporating a gaseous component and the enhanced sensitivity of explosive compositions comprising gaseous components are well known to those skilled in the art. The gaseous components may, for example, be incorporated into the explosive composition as fine gas bubbles dispersed through the composition, as hollow particles which are often referred to as microballoons or as microspheres, as porous particles, or mixture thereof. The gas may be chemically introduced, generated as in a whipping process, or introduced as bubbles in any mechanical manner known to those skilled in this art.

Having described the processes and products of the present invention, these processes and products will now be described, by way of non-limiting example only, with respect to the following examples.

EXAMPLES

Example 1

Since waste emulsion explosives can vary from their intended formulations in a number of ways, testing was conducted on typical commercial emulsion explosive formulations, since inevitably such formulations become waste emulsions. Further, the invention hereof is not limited simply to waste emulsions, but to emulsions generally. It is expected that the emulsion physical properties of nearly all emulsions and/or waste emulsions will be similar enough to the commercial products that a valid comparison can be made. Accordingly, commercial emulsion explosives were mixed with varying amounts of a polyglycol bottom material having a formulation as set out hereinabove in Table 1.

In this example, equal parts of a commercial emulsion explosive (MAGNAFRAC R-9025-V) and the polyglycol bottom material (PGB-90) were mixed in a Hobart mixer at slow speed. The emulsion material rapidly (less than 10 seconds) broke down to form a black homogeneous liquid, the broken-emulsion. Stirring was discontinued, and the homogenous mixture was left undisturbed. After 4 hours, the mixture remained homogenous, and had a viscosity of 1.20 g/ml.

The broken-emulsion was used in the preparation of an ANFO-type explosive. Explosive grade ammonium nitrate (EGAN) prills were coated with the broken-emulsion in the ratio of 3 parts, by weight, of EGAN prills to 1 part, by weight, of the polyglycol bottoms/waste emulsion explosive mixture (PGEM). The coated material had a density of 1.04 g/cc.

When tested for explosive properties, this coated material displayed the following characteristics after a one day storage period:

| Cartridge Diameter | Primer | VOD* (km/sec) |
|---|---|---|
| 75 mm | P-16 | Failed |
| 90 mm | P-16 | 1.6 km/sec |

*Velocity of detonation

Similar broken-emulsion formulations were also prepared using commercial emulsion explosive materials from three different suppliers. All emulsions rapidly broke down in about 10 seconds or less, after the addition of the polyglycol bottom material, to provide essentially homogeneous liquid materials.

Example 2

Two parts of a commercial emulsion explosive were mixed with one part of the polyglycol bottom material identified in Table 1. The emulsion rapidly broke down within 10 seconds to give the broken-emulsion. One part of this mixture was mixed with 2 parts of ammonium nitrate prills to provide a coated product having a density of 1.08 g/cc. The explosive properties of the coated product, after 1 day of storage, were as follows:

| Cartridge Diameter | Primer | VOD (km/sec) |
|---|---|---|
| 75 mm | P-16 | 1.9 |
| 90 mm | P-16 | 2.1 |

Having described specific embodiments of the present invention, it will be understood that modifications thereof may be suggested to those skilled in the art, and it is intended to cover all such modifications as fall within the scope of the appended claims.

I claim:

1. A broken-emulsion comprising polyglycol bottoms and an emulsion explosive characterized by a substantially single liquid phase.

2. The broken-emulsion of claim 1 wherein said polyglycol bottoms and said emulsion explosive are combined in a ratio of 0.5 polyglycol bottoms to 1 emulsion explosive by volume.

3. The broken-emulsion of claim 1 wherein said polyglycol bottoms and said emulsion explosive are combined in a ratio ranging from 0.5 to 40 polyglycol bottoms to 1 emulsion explosive by volume.

4. The broken-emulsion of claim 1 wherein said polyglycol bottoms and said emulsion explosive are combined in a ratio ranging from 1.5 to 2.5 polyglycol bottoms to 1 emulsion explosive by volume.

5. The broken-emulsion of claim 1 wherein said broken-emulsion is combined with solid ammonium nitrate.

6. The broken-emulsion of claim 1 wherein said broken-emulsion is combined with solid ammonium nitrate prills.

7. The broken-emulsion of claim 1 wherein said broken-emulsion comprises polyglycol bottoms and waste emulsion.

8. The broken-emulsion of claim 1 wherein said broken-emulsion is combined with ammonium nitrate, and microballoons.

9. The broken-emulsion of claim 1 wherein said broken-emulsion is combined with ammonium nitrate, and sensitizer.

10. The broken-emulsion of claim 1 wherein said broken-emulsion is combined with ammonium nitrate and a gas.

11. The broken-emulsion of claim 1 wherein said broken-emulsion is combined with an oxidizer salt and a sensitizer.

12. The broken-emulsion of claim 1 wherein said broken-emulsion is combined with an oxidizer salt and a sensitizer to form an admixture wherein said broken-emulsion comprises less than 50% by weight of said admixture.

13. The broken-emulsion of claim 1 wherein said broken-emulsion is combined with an oxidizer salt and a sensitizer to form an admixture wherein said broken-emulsion comprises between 5 and 40 weight per cent of said admixture.

14. The broken-emulsion of claim 1 wherein said broken-emulsion is combined with an oxidizer salt and a sensitizer to form an admixture wherein said broken-emulsion comprises between 10 and 35 weight per cent of said admixture.

15. The oxidizer salt of claim 14 wherein said salt is ammonium nitrate.

16. The sensitizer of claim 14 wherein said sensitizer is a gas.

17. The broken-emulsion of claim 1 wherein said broken-emulsion is combined with waste-water.

18. The broken-emulsion of claim 1 wherein said broken-emulsion is combined with emulsion not broken.

19. The broken-emulsion of claim 1 wherein said broken-emulsion is in combination with discontinuous phases of emulsion and solid oxidizer.

20. A method of making a broken-emulsion comprised of the steps:

a) combining polyglycol bottoms and b) emulsion explosives to form an admixture, c) mechanically mixing said admixture until said admixture becomes a single liquid phase.

21. The method in claim 20 wherein said emulsion explosives is waste emulsion explosives.

22. The method of claim 20 wherein ammonium nitrate is combined with said admixture to form an explosive.

23. The method of claim 22 wherein a sensitizer is combined with said explosive.

* * * * *